US010578336B2

(12) United States Patent
Schneider et al.

(10) Patent No.: US 10,578,336 B2
(45) Date of Patent: Mar. 3, 2020

(54) AIR FLAP DEVICE

(71) Applicant: Röchling Automotive SE & Co. KG, Mannheim (DE)

(72) Inventors: Jürgen Schneider, Worms (DE); Jörg Schönleber, Manubach (DE)

(73) Assignee: RÖCHLING AUTOMOTIVE SE & CO. KG, Mannheim (DE)

( * ) Notice: Subject to any disclaimer, the term of this patent is extended or adjusted under 35 U.S.C. 154(b) by 870 days.

(21) Appl. No.: 14/996,760

(22) Filed: Jan. 15, 2016

(65) Prior Publication Data

US 2016/0215998 A1 Jul. 28, 2016

(30) Foreign Application Priority Data

Jan. 22, 2015 (DE) ..... 10 2015 201 076

(51) Int. Cl.
*F24F 13/10* (2006.01)
*F24F 13/14* (2006.01)

(52) U.S. Cl.
CPC ..... *F24F 13/10* (2013.01); *F24F 2013/146* (2013.01)

(58) Field of Classification Search
CPC ..... F24F 13/10; F24F 2013/146
USPC ..... 454/333
See application file for complete search history.

(56) References Cited

U.S. PATENT DOCUMENTS

| | | | | |
|---|---|---|---|---|
| 3,774,879 A | 11/1973 | Zink | | |
| 4,273,308 A | 6/1981 | Nakai | | |
| 9,038,987 B2 * | 5/2015 | Hegner | F02D 9/106 | 251/305 |

FOREIGN PATENT DOCUMENTS

| | | | | |
|---|---|---|---|---|
| DE | 20 63 369 C3 | 4/1975 | | |
| DE | 28 20 208 A1 | 11/1979 | | |
| DE | 29 44 379 A1 | 5/1980 | | |
| DE | 80 13 350 U1 | 8/1980 | | |
| DE | 20 2010 012 100 U1 | 2/2011 | | |
| DE | 102010030412 A1 * | 12/2011 | B24B 55/10 | |
| DE | 10 2013 202 342 A1 | 8/2014 | | |
| EP | 1 471 314 A1 | 10/2004 | | |

OTHER PUBLICATIONS

Search Report issued for German Patent Application No. 10 2015 201 0761 dated Dec. 2, 2015, with machine English translation (12 pages).

* cited by examiner

*Primary Examiner* — Edelmira Bosques
*Assistant Examiner* — Dana K Tighe
(74) *Attorney, Agent, or Firm* — Price Lobel Tye LLP

(57) ABSTRACT

An air flap device comprises a housing with an air flow passage section. At least one air flap is mounted on a first and on a second mounting point on the housing. The second mounting point is located at an axial distance from the first mounting point. The air flap is rotatable around the pivot axis defining the axial direction. By pivoting the at least one air flap relative to the housing, the effective flow cross-section of the air flow passage section can be modified. The air flap(s) is mounted on the mounting points with an axial play relative to the housing. At least one spring assembly is arranged such that at least one part of an axial movement of the air flap(s) occurs within its play relative to the housing in the direction of the first or/and the second mounting point, against a pre-tensioning effect of the spring assembly.

5 Claims, 4 Drawing Sheets

AIR FLAP DEVICE

CROSS REFERENCE TO RELATED APPLICATION(S)

Figure 1:
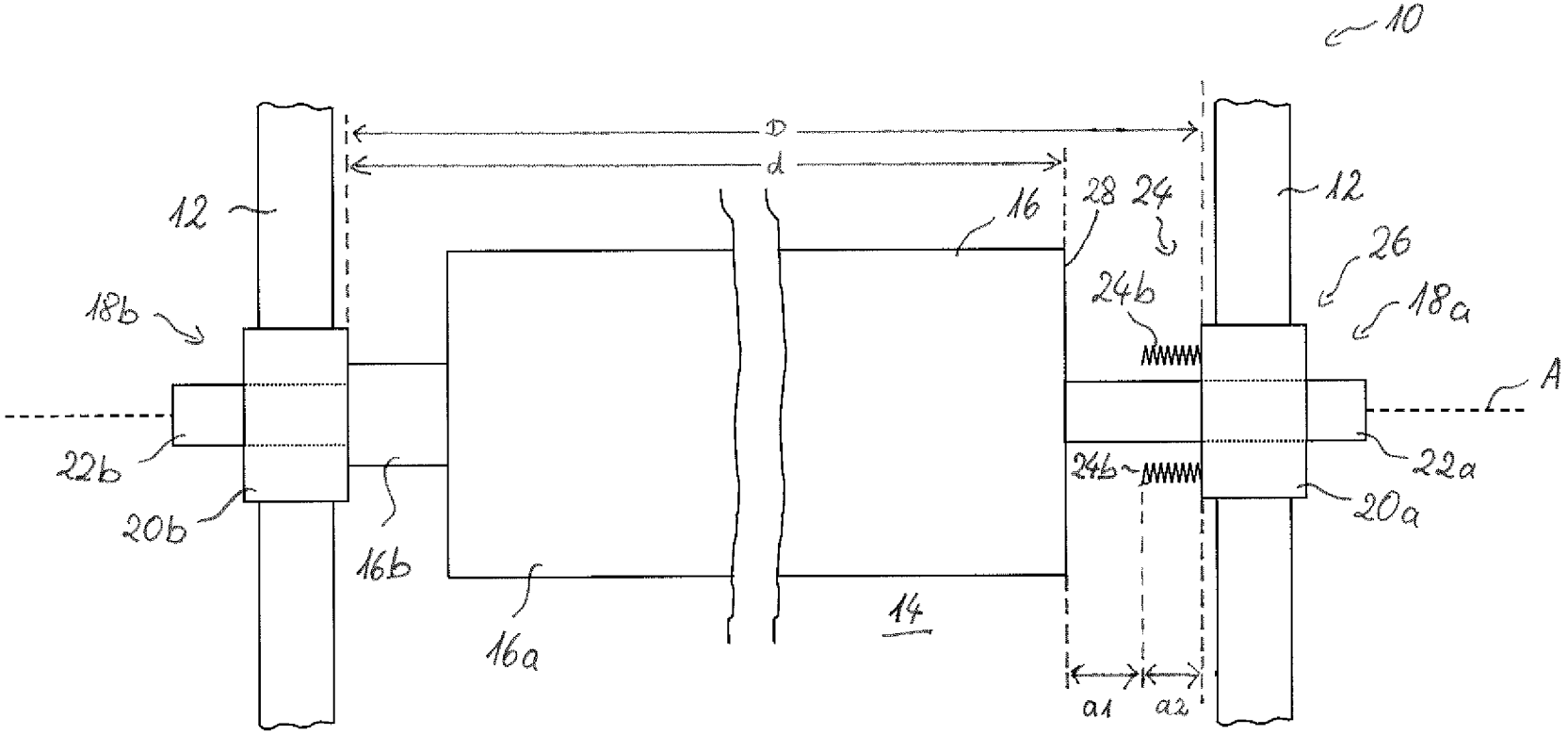

This application claims priority to German Application No. 10 2015 201 076.7, filed Jan. 22, 2015. The entirety of the disclosure of the above-referenced application is incorporated herein by reference.

BACKGROUND OF THE INVENTION

Field of the Invention

The present invention relates to an air flap device comprising a housing with an air flow passage section, as well as at least one air flap that is mounted on a first and on a second mounting point on the housing, the second mounting point being located at an axial distance from the first mounting point, such that the air flap pivots around a swivel axis defining the axial direction, so that the effective flow cross-section of the air flow passage section can be modified by pivoting the at least one air flap relative to the housing, wherein the at least one air flap is mounted on the mounting points with an axial play relative to the housing.

SUMMARY OF THE INVENTION

By mounting the at least one air flap with an axial play relative to the housing, a housing can be used for pivotably mounting air flaps whose axial length is not uniform owing to production-related tolerances. Furthermore, air flaps having a higher thermal coefficient of linear expansion in the axial direction than the housing can be accommodated thereon.

Undesirable random relative movements in the axial direction between the air flap and the housing are, however, also made possible by the axial play, said random movements resulting in undesirable background noise due to the associated collisions between the air flap and the housing which stop these movements. In addition, these collisions increase the mechanical stress acting on the air flap and the housing, which can negatively affect the functionality and the lifetime of such an air flap device.

It is therefore the object of the invention to provide an air flap device with which the noise emission associated with an axial movement of an air flap within its play relative to housing as well as the mechanical stress on the air flap and the housing, are reduced compared to the state of the art.

According to a first aspect of the invention, this object is attained by means of the air flap device defined above, which comprises at least one spring assembly that is arranged such that at least one part of an axial movement of the at least one air flap occurs within its play relative to the housing in the direction of a first or/and second mounting point against the pre-tensioning effect of the at least one spring assembly.

With the at least one part of the axial movement of the at least one air flap within its play relative to the housing against the pre-tensioning effect of the at least one spring assembly, at least one part of the kinetic energy of the at least one air flap will be transformed into a mechanical deformation of the at least one spring assembly in the axial direction. In that way, the kinetic energy of the at least one air flap decreases in the axial direction, as a result of which a collision of the air flap and the housing is either prevented, or at least the energy exchanged in the collision between the air flap and the housing is reduced compared to the case in which no spring assembly is provided. This, in turn, reduces the noise generation and the mechanical stress on the air flap and the housing compared to the case in which no spring assembly is provided.

In order to achieve an effective transformation of the kinetic energy of an air flap into the mechanical deformation of a spring assembly in the axial direction, it is preferred that at least one spring assembly has a Hookean behavior because in that way, the at least one part of the axial movement of the at least one air flap within its play relative to the housing in the direction of the first or/and the second mounting point, which occurs against the pre-tensioning effect of the at least one spring assembly, occurs against the increasing pre-tensioning effect of the at least one Hookean spring assembly.

The first or second mounting point is in general the place on the housing on which the at least one air flap is mounted. The mounting point can be configured on a section of the housing made in one piece, or on a bearing arrangement provided separately from the housing.

The at least one air flap can have a flap body which has a flap shaft section extending in the axial direction on each of two opposing axial end sections, wherein the flap shaft sections are arranged coaxially to each other and are mounted on the first, or, as the case may be, second mounting point.

In the context of the invention, it is in principle possible to provide a spring assembly on both the first and the second mounting point. Both of these spring assemblies can be configured either as compression springs or as tension springs and they are preferentially identical. It is particularly preferred that both spring assemblies are identically constructed compression springs because compression springs, in contrast to tension springs, do not have to be attached to any additional component in order to exert a pre-tension force on the air flap. If the at least one air flap is constructed as described above, with a flap body and a flap shaft section, two identically constructed spring assemblies, arranged on the first and second mounting points, preferably pre-tension the at least one air flap such that the flap body is in balance in an axial middle position between the first and the second mounting point.

In order to provide a simple and compact construction with a small number of spring assemblies, it is however preferred if the at least one spring assembly is provided on a pre-tensioned mounting point that consists of the first and second mounting points. The at least one spring assembly provided on the pre-tensioned mounting point can then be configured such that at least part of an axial movement of the at least one air flap occurs within its play relative to the housing only in the direction of the pre-tensioning mounting point against the pre-tensioning effect of the at least one spring assembly. The at least one spring assembly can, for example, be subjected to compression during the at least one part of the axial movement.

It is, however, also conceivable that at least one spring assembly can be attached both to the pre-tensioning mounting point and to the at least one air flap in such a manner that the at least one spring assembly will be subjected to compression during one part of an axial movement of the at least one air flap relative to the housing in the direction of the pre-tensioning mounting point, and that the at least one spring assembly will be subjected to tension during one part of an axial movement of the at least one air flap relative to the housing away from the pre-tensioning mounting point. In this way, with the at least one spring assembly provided on the pre-tensioning mounting point that consists of the first and the second mounting point, it can be ensured that at least one part of an axial movement of the at least one air flap relative to the housing will occur in the direction of both the first and the second mounting point against a pre-tensioning effect of the at least one spring assembly.

In a further development of the invention, it can be provided that the at least one spring assembly on the pre-tensioning mounting point axially pre-tensions a stop surface on the side of the housing and the opposing stop surface on the side of the air flap in contact engagement with each other, wherein the stop surface and the opposing stop surface can be rotated around the pivot axis relative to each other. In this case, it is conceivable that the spring assembly itself provides either the stop surface on the side of the housing or the opposing stop surface on the side of the air flap, or that one of these surfaces is provided by an additional component that is axially displaceable relative to the housing. In the latter case, the spring assembly can be supported at one end on the housing and at the other end on the axially displaceable component, or at one end on the at least one air flap and at the other end on the axially displaceable component. An axial gap between the air flap and the housing that exists due to the axial play can be at least partially closed by means of the axially displaceable component, so that an undesirable flow of air through the air flow passage section resulting from this gap can be at least partially eliminated. An effective closure of the axial gap can be achieved by arranging the axially displaceable component in the axial gap.

In this embodiment, it is advantageous, if the axially displaceable component provides not only the stop surface, or, as the case may be, the opposing stop surface, but also fulfills an additional function for which an additional component would otherwise have to be provided. In this case, it can be provided that the axially displaceable component is configured as a bearing component, and that the at least one spring assembly is supported at one end on the housing and at the other end on the bearing component that is axially displaceable relative to the housing, and has the stop surface on the side of the housing. In this embodiment, the axially displaceable component essentially fulfills two functions. On the one hand, it contributes to the bearing of the at least one air flap, and on the other hand, it provides the stop surface on the side of the housing.

In order to prevent a relative movement between the spring assembly and the bearing component, which likewise causes background noise, a further development of the invention can provide that the at least one spring assembly is attached to the bearing component. In the interest of a simple assembly of the air flap device, the spring assembly is preferentially configured in one piece with the bearing component.

In a further development of the invention, it can be provided that the spring assembly pre-tensions the at least one air flap at a stop mounting point that consists of the first and the second mounting point in contact engagement with a stop surface that cannot be moved around the pivot axis in the circumferential direction.

In this embodiment, the at least one air flap must have a certain kinetic energy in the axial direction facing away from the stop surface in order to release itself from the stop surface against the pre-tensioning effect of the at least one spring assembly. In this way, the occurrence of this type of background noise, which would develop at low kinetic energies of the at least one air flap in the absence of such a pre-tensioning spring assembly, can at least be eliminated. Because the stop surface cannot be moved in the circumferential direction, the stop surface itself will not produce any background noise. It is, therefore, preferred if the stop surface is also not displaceable in the axial direction. If is further preferred if the contact mounting point is not the pre-tensioning mounting point, but that these points are arranged axially spaced apart, at opposing end regions of the at least one air flap. In this way, an interaction of the at least one air flap with a spring assembly provided on the pre-tensioning mounting point resulting in background noise can be eliminated when there is a collision with the stop surface. For this reason, it is also advantageous if the contact mounting point is free of a spring assembly that pre-tensions in the axial direction.

According to a second aspect of the present invention, the object mentioned above is attained by means of an air flap device defined above, in which the housing comprises a stop element that limits the axial play of the at least one air flap, wherein the stop element is displaceable in the axial direction relative to the housing in such manner that, depending on the axial position of the stop element, the axial play of the at least one air flap relative to the housing can be modified.

An axial movement of the at least one air flap within its play can be restricted by the adjacent element that is displaceable in the axial direction, if production-related tolerances can be ignored, and only a differential thermal expansion behavior of the air flap and the housing in the axial direction has to be taken into account. A precise adjustment of the axial position of the stop element, and thus a precise adjustment of the axial play, can preferentially be ensured in that the stop element is substantially continuously adjustable relative to the housing. For this purpose, the stop element can have at least one slot whose main direction of extension runs in the axial direction. This can be used for the attachment of the stop element to the housing, for example by means of screws.

In a further development of the invention, it can be provided that the stop element is a bearing arrangement provided on a first or second mounting point, which contributes to the pivotable mounting of the at least one air flap. Because the stop element is a bearing arrangement, it essentially fulfills two functions, namely, on the one hand as a stop limiter and on the other hand as a mounting. This double functionality contributes to a compact overall construction, as two separate components do not have to be provided for the mounting and for the stop limitation.

The assembly of an air flap device according to the second aspect of the invention can comprise the following steps:

a) arrangement of the at least one air flap in the air flow passage section on the first or on the second mounting point such that a first play limiting surface of the at least one air flap abuts against a play limiting surface of the first or of the second mounting point,
b) selection of a spacer dependent on an expected temperature change and on the coefficients of longitudinal expansion of the at least one air flap and of the housing,
c) arrangement of the spacer such that it abuts against a second surface that limits the play of the at least one air flap,
d) displacement of the stop element in the axial direction such that a play limiting surface of the stop element abuts against the spacer,
e) attachment of the stop element on the housing,
f) removal of the spacer.

With this assembly method, the axial play is adjusted such that, with an expected increase of the maximum temperature relative to the assembly temperature, the play will be reduced such that the at least one air flap can still be pivotable relative to the housing. For this purpose, the exact axial dimensions of the air flap and of the housing, as well as their longitudinal coefficients of thermal expansion in the axial direction must be known. Based on these values, the maximum play required in the axial direction can be calculated and a correspondingly dimensioned spacer can then be selected in step b). A very simple adjustment of the play in the axial direction according to the steps d) to e) can then be carried out by means of the spacer.

BRIEF DESCRIPTION OF THE DRAWING FIGURES

Figure 2:
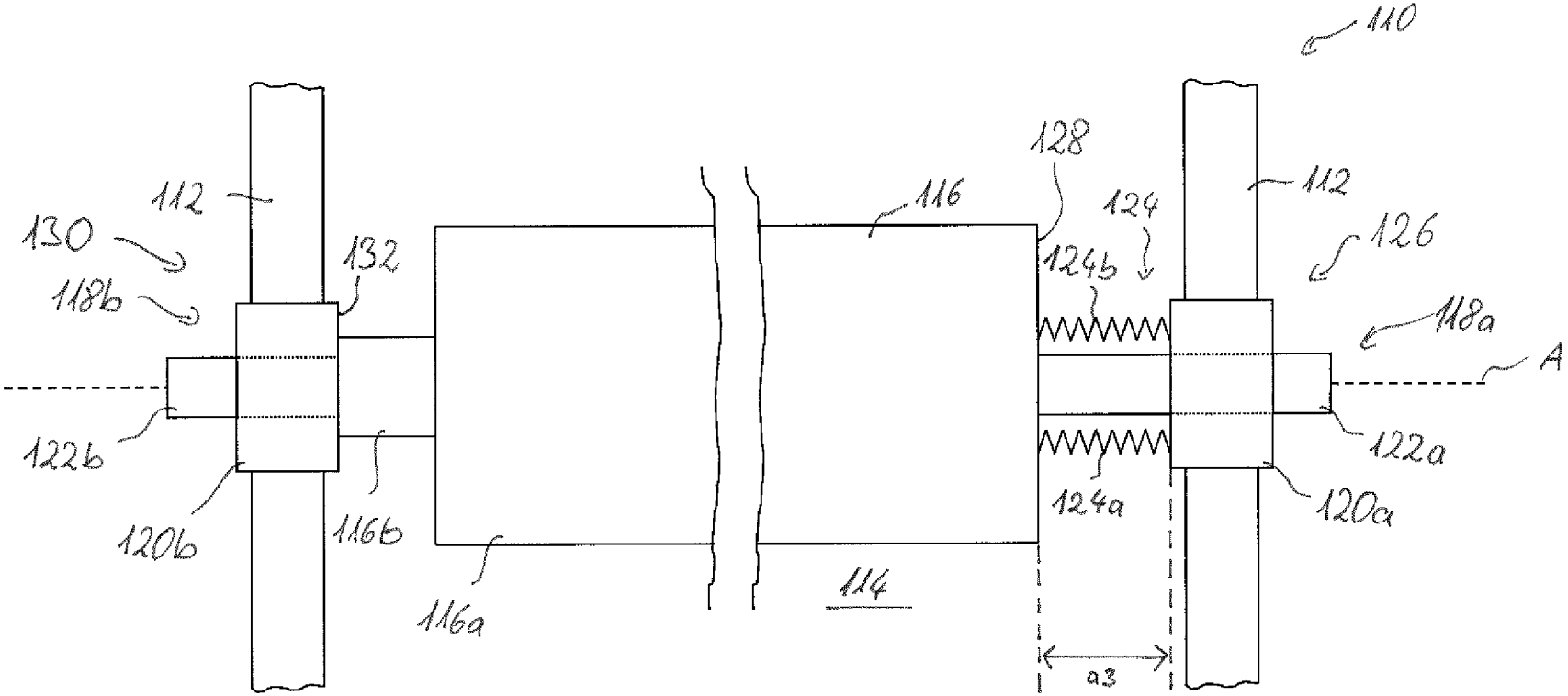
Figure 3:
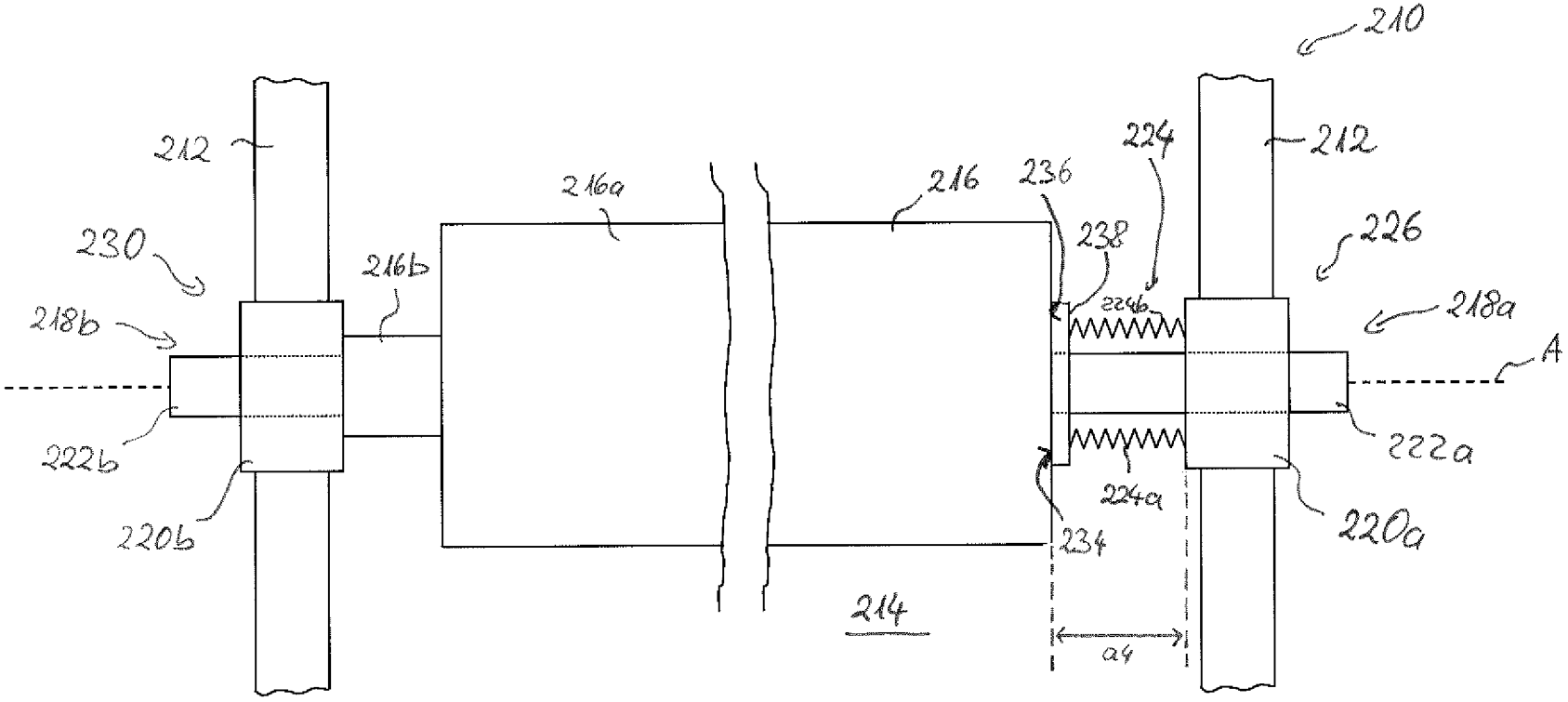
Figure 4:
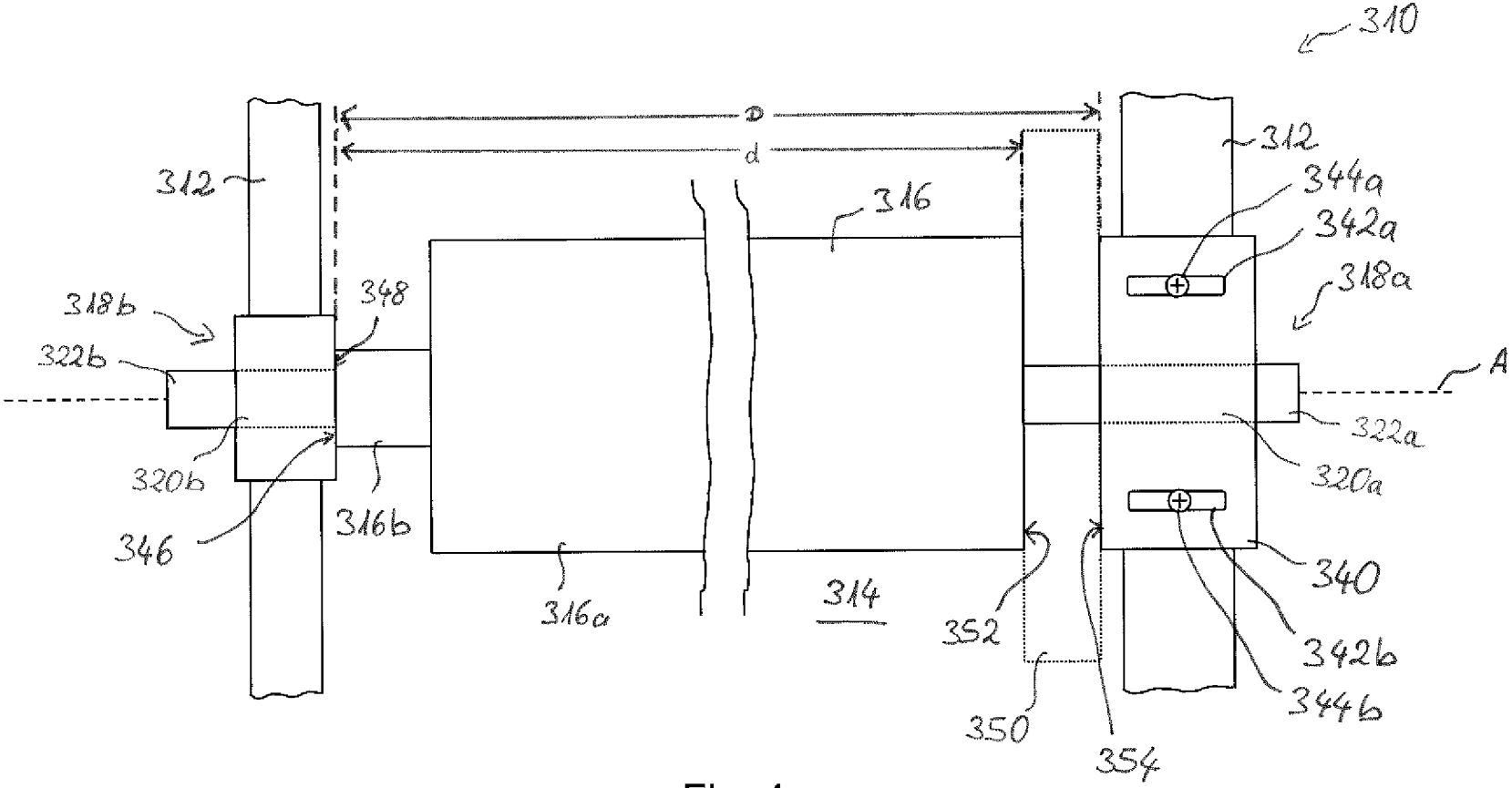

The invention will be explained in more detail below with reference to the attached drawings. They show:

FIG. 1 a schematic view of an inventive air flap device according to a first embodiment with a spring assembly provided on a pre-tension-mounting point, FIG. 2 a schematic view of an inventive air flap device according to a second embodiment with an air flap held by a spring assembly in contact engagement with a stop surface, FIG. 3 a schematic view of an inventive air flap device according to a third embodiment with an axially displaceable bearing component, and FIG. 4 a schematic view of an inventive air flap device according to a fourth embodiment with a stop element that is displaceable in the axial direction.

In FIG. 1, an air flap assembly is in general provided with the reference numeral 10. This device comprises a housing 12 with an air flow passage section 14 as well as an air flap 16 mounted on the housing 12 on a first mounting point 18 and on a second mounting point 18*b* located at an axial distance D from the first mounting point, said air flap being pivotably mounted around a pivot axis defining the axial direction A in such a manner that by pivoting the at least one air flap 16 relative to the housing 12, the effective flow cross-section of the air flow passage section 14 can be modified. As shown in FIG. 1, the air flap 16 can have an air flap body 16*a* as well as axial extension 16*b* provided on an axial end section of the air flap body 16*a*.

As shown in FIG. 1, on the first mounting point 18*a* and on the second mounting point 18*b*, a first, or, as the case may be, a second bearing arrangement 20*a*, 20*b* can be provided, which can be configured, for example, separately from the housing, and which can respectively accommodate an air flap shaft section 22*a*, or, as the case may be, 22*b* of the air flap 16.

DETAILED DESCRIPTION OF THE PREFERRED EMBODIMENTS

In the case of the air flap device 10 shown in FIG. 1, the axial distance D of the mounting points 18*a* and 18*b* from each other is greater than the axial length d of the air flap 16. This makes it possible to mount the air flap 16 on the mounting points 18*a* and 18*b* with an axial play relative to the housing 12. In this way, with the predefined axial distance D of the mounting points 18*a* and 18*a*, it is possible to mount an air flap 16 whose axial length d is subject to production-related tolerances on the mounting points 18*a* and 18*b*. Furthermore, due to the axial play, a different thermal expansion behavior of the air flap 16 and the housing 12 in the axial direction A can be compensated.

In addition, the air flap device 10 shown in FIG. 1 has a spring assembly 24 that can, for example, have a plurality of spring elements 24*a*, 24*b* configured as spiral springs. As shown in FIG. 1, the spring assembly 24 can be arranged on a first and second mounting point 18*a*, 18*b* that functions as a pre-tensioning mounting point 16. Furthermore, as is also shown in FIG. 1, the spring assembly 24 can, be attached to the bearing arrangement 20 provided at the pre-tensioning mounting point 26, or preferentially configured in one piece with said bearing arrangement.

In the axial position of the air flap 16 relative to the housing 12 shown in FIG. 1, there is no direct contact between the air flap 16 and the spring assembly 24. The spring assembly 24 in FIG. 1 is, therefore, in an untensioned state. An axial movement of the air flap 16 relative to the housing 12 in the direction of the pre-tensioning mounting point 26 is initially unaffected by the spring assembly 24, as long as the axial position of a stop surface 28 of the air flap 16 pointing toward the spring assembly 24 is in the axial region a1. If, during a sustained movement of the air flap 16 relative to the housing 12, the contact surface 28 comes into contact with the spring assembly 24, the subsequent part of the axial movement, in which the axial position of the stop surface 28 is in the axial region a2, occurs under the pre-tensioning effect of the spring assembly 24. In this case, at least part of the kinetic energy of the air flap 16 is transformed into the mechanical deformation of the spring assembly 24 in the axial direction A, so that the air flap 16 is continually braked, and in contrast to the case in which no spring assembly 24 is provided, thus does not abruptly release its kinetic energy during a collision with the housing 12 or with the bearing arrangement 20*a*. As a result of this, the noise produced during the operation and the mechanical stress on the air flap device 10 are both reduced compared to the case in which no spring assembly 24 is provided.

FIG. 2 shows a second embodiment of the invention. The same and functionally identical components of the first embodiment are provided with the same reference numeral in the second embodiment shown in FIG. 2, but increased by 100. The second embodiment will only be described to the extent that it is different from the first embodiment, express reference being made in other respects to the description of the first embodiment.

The second embodiment differs from the first embodiment in that the spring assembly 124 pre-tensions the air flap 116 on a stop mounting point 130 that is in contact engagement with a stop surface 132 that cannot be moved around the pivot axis in the circumferential direction. In this connection, the spring assembly 124 extends in an axial intermediate section a3 between the stop surface 128 of the air flap 116 and the pre-tensioning mounting point 126. In the case of the air flap device 110 according to the second embodiment, the air flap 166 must have a certain kinetic energy in the axial direction A in order to release itself from the stop surface 132 against the pre-tensioning effect of the spring assembly 124. As long as the air flap 116 does not have sufficient kinetic energy in the axial direction A, and therefore cannot release itself from the stop surface, no background noise can occur due to a collision between the air flap 116 and the stop surface 132 during an axial movement of the air flap 116 in the direction of the stop surface 132. In order to provide a particularly effective suppression of the background noise, the stop surface 132 can be immovable in both the circumferential direction and the axial direction A.

Even though the air flap devices 10, 110 shown in the FIGS. 1 and 2 were described above as different embodiments, it can, in this case, be the same air flap device at different temperatures, for example, when the air flap 16, 116 and the housing 12, 112 have a different thermal expansion behavior in the axial direction A, and the longitudinal coefficient thermal expansion of the air flap 16, 116 is greater in the axial direction A than the longitudinal coefficient of thermal expansion of the housing 12, 112 in the axial direction A. In such a case, FIG. 1 would show the air flap device 10, 110 at a temperature T1, and FIG. 2 would show the air flap device 10, 110 at a temperature T2, wherein T1 is smaller than T2. With an identical thermal expansion behavior of the air flap 16, 116 and of the housing 12, 112 in the axial direction A, the difference between these two figures could also be due only to a thermal expansion of the spring assembly 24, 124 in the axial direction A.

FIG. 3 shows a third embodiment of the present invention. In the third embodiment shown in FIG. 3, same and functionally identical components of the second embodiment are provided with the same reference numeral, but increased by 100. The third embodiment will only be described to the extent that it is different from the first and second embodiment, express reference being made in other respects to the description of the first two embodiments.

The air flap device 210 shown in FIG. 3 differs from the air flap device 110 shown in FIG. 2 in that a spring assembly 224 is provided on a pre-tensioned mounting point 226 in such a way that it axially pre-tensions a stop surface 234 on the side of the housing and an opposing stop surface 236 on the side of the air-flap in contact engagement with each other, wherein the stop surface 234 and the opposing stop surface 236 are rotatable relative to each other around a pivot axis of the air flap 216. As shown in FIG. 3, the stop surface 234 can be provided by a component 238 that is displaceable in the axial direction A, wherein the spring assembly 214 is supported at one end on the pre-tensioning mounting point 226 and at the other end on the axially displaceable component 238. Due to this axially displaceable component 238, it is ensured, on the one hand, that the opposing stop surface 236 on the side of the air flap does not come into direct sliding contact with the spring assembly 224, which could otherwise lead to an impairment of the possibility to pivot the air flap 216 relative to the housing 212 due to sharp-edged or pointed end sections of the spring assembly 224. On the other hand, an axial gap a4 between the air flap 216 and the housing 212, which exists due to the axial play, can be at least partially closed by the axially displaceable component 238, so that an undesirable flow of air through the air flow passage section 214 can be at least partially eliminated.

In order to provide a compact overall construction, the component 238 is preferentially an axially displaceable bearing component. With a design of this type, the component 238 would provide, on the one hand, a stop surface 234 and, on the other hand, at least partially support the air flap 216. With this design, the axially displaceable component 238 would thus fulfill two functions and in that way contribute toward a compact overall construction of the air flap device 210.

FIG. 4 shows a fourth embodiment of the invention. The air flap device 310 shown in FIG. 4 comprises a housing 312 with an air flow passage section 314 and an air flap 316 mounted on a first mounting point 318*a* and on a second mounting point 318*b* that is located at an axial distance D from this first mounting point on the housing 312*a*, said air flap being pivotably mounted around a pivot axis defining the axial direction A in such manner that by pivoting the at least one air flap 316 relative to the housing 312, the effective flow cross-section of the air flow passage section 314 can be modified. Similar to those in the previous embodiments, the air flap 316 can have an air flap body 316*a* as well as an axial extension 316*b* provided on an axial end section of the air flap body 16*a*.

In addition, on the first mounting point 318*a* and on the second mounting port 318*b*, a first, or, as the case may be, a second bearing arrangement 320*a*, 320*b* can be provided, which, for example, can be configured separately from the housing 312, and which can in each case support an air flap shaft section 322*a*, or, as the case may be, 322*b* of the air flap 316.

In the fourth embodiment, the air flap 316 is also mounted on the bearing arrangements 318*a*, 318*b* with an axial play relative to the housing, i.e. the axial distance D of the mounting points 318*a* and 318*b* to each other is greater than the axial length d of the air flap 316. The housing 312 in the fourth embodiment has a stop element 340 that limits the axial play of the air flap 316, wherein said stop element is displaceable in the axial direction A relative to the housing 312 in such a manner that, subject to the axial position of the stop element 340, the axial movement of the air flap 316 within the limits of its play relative to the housing 312 can be modified.

Due to the displaceability of the axial stop element 340, an axial movement of the air flap 316 within the limits of its play can be precisely restricted, particularly when production-related tolerances can be ignored.

The stop element 340 can, for example, be provided with a plurality of slots 342*a*, 342*b* whose main directions of extension run axially.

They can be used for a substantially continuous adjustment of the stop element 340 in the axial direction A by means of screws 344*a*, 344*a*.

The stop element 340 is preferentially a bearing arrangement 320*a* provided on a mounting point that consists of the first and second bearing point 318*a*, 318, said bearing arrangement at least contributing to a pivotable mounting of the air flap 316. Such a dual function for the stop element 340 contributes to a compact overall construction of the air flap 310 because two different components are not required for mounting the air flap 316 and for limiting the axial movement of the air flap 316 within the limits of its play.

When mounting an air flap device 310 according to the fourth embodiment, the following steps can include:

a) arrangement of the air flap 316 in the air flow passage section 314 on the second mounting point 318*b* such that a first surface 346 limiting the play of the air flap 316 abuts against a play limiting surface 348 of the second mounting point 318*b*,
b) selection of a spacer 350, which is shown as a dotted line in FIG. 4, subject to an expected temperature change and to the coefficients of longitudinal expansion of the air flap 316 and of the housing 312,
c) arrangement of the spacer 350 such that it abuts against a second play limiting surface 352 of the air flap 316,
d) adjustment of the stop element 350 in the axial direction A such that a play limiting surface 354 of the stop element 340 abuts against the spacer 350,
e) attachment of the stop element 340 to the housing 312,
f) removal of the spacer 350.

With this assembly procedure, the axial play is adjusted such that with an expected maximum temperature increase relative to the assembly temperature, the play is reduced to such an extent that the at least one air flap 316 is still pivotable relative to the housing 312. For this purpose, the exact axial dimensions of the air flap 316 and of the housing 312, as well as their longitudinal coefficients of thermal expansion in the axial direction A must be known. On the basis of these values, the maximum required play in the axial direction A can be calculated and a correspondingly dimensioned spacer 350 can then be selected in step b). A very simple adjustment of the play in the axial direction A can then be carried out according to the steps d) to e) by means of the spacer 350.

The invention claimed is:

1. An air flap device, comprising:

a housing with an air flow passage section as well as at least one air flap that is mounted on a first and on a second mounting point on the housing, the second mounting point being located at an axial distance from the first mounting point such that the air flap is pivotably mounted around a pivot axis defining an axial direction, so that by pivoting the at least one air flap relative to the housing an effective flow cross section of the flow passage section can be modified, wherein the at least one air flap is mounted on the mounting points with an axial play relative to the housing;

at least one spring assembly which is arranged such that at least one part of an axial movement of the at least one air flap in the direction of the first or/and of the second mounting point within axial play relative to the housing occurs against a pre-tensioning effect of the at least one spring assembly;

wherein the at least one spring assembly is provided on a pre-tensioning mounting point selected out of the first and the second mounting point, wherein the at least one spring assembly on the pre-tensioning mounting point axially pre-tensions a stop surface on a side of the housing and an opposing stop surface on a side of the air flap in contact engagement with each other, wherein the stop surface and the opposing stop surface are rotatable around the pivot axis relative to each other, wherein the at least one spring assembly is supported at one end on the housing and at the other end on a bearing component that is axially displaceable relative to the housing, said bearing component having the stop surface on the side of the housing, wherein the at least one spring assembly is configured in one piece with said bearing component, and wherein the at least one spring assembly pre-tensions the at least one air flap on a stop-mounting point selected out of the first and the second mounting point in contact engagement with a stop surface that cannot be moved around the pivot axis in the circumferential direction, wherein the stop-mounting point is not a pre-tensioning mounting point.

2. The air flap device according to claim 1, wherein the stop-mounting point is free of a spring assembly that pre-tensions in the axial direction.

3. The air flap device according to claim 1, wherein the at least one spring assembly pre-tensions the at least one air flap on a stop-mounting point that consists of the first and of the second mounting point in contact engagement with a stop surface that cannot be moved around the pivot axis in the circumferential direction, also cannot be moved around the pivot axis in the axial direction.

4. An assembly process for assembling an air flap assembly according to claim 1, the process comprising the steps:

a) arranging at least one air flap in the flow passage section on the first or on the second mounting point such that a first play limiting surface of the at least one air flap abuts against a play limiting surface of the first or of the second mounting point, b) selecting a spacer subject to an expected temperature change and to the coefficients of longitudinal expansion of the at least one air flap and of the housing, c) arranging the spacer such that it abuts against a second play limiting surface of the at least one air flap, d) adjusting the stop element in the axial direction such that a play limiting surface of the stop element abuts against the spacer, e) attaching the stop element to the housing, f) removing the spacer, and g) arranging at least one spring assembly such that at least one part of an axial movement of the at least one air flap in the direction of the first or/and of the second mounting point within axial play relative to the housing occurs against a pre-tensioning effect of the at least one spring assembly, wherein the at least one spring assembly is provided on a pre-tensioning mounting point selected out of the first and the second mounting point, wherein the at least one spring assembly on the pre-tensioning mounting point axially pre-tensions a stop surface on a side of the housing and an opposing stop surface on a side of the air-flap in contact engagement with each other, wherein the stop surface and the opposing stop surface are rotatable around the pivot axis relative to each other, wherein the at least one spring assembly is supported at one end on the housing and at the other end on a bearing component that is axially displaceable relative to the housing, said bearing component having the stop surface on the side of the housing, wherein the at least one spring assembly is configured in one piece with said bearing component, and wherein the at least one spring assembly pre-tensions the at least one air flap on a stop-mounting point selected out of the first and the second mounting point in contact engagement with a stop surface that cannot be moved around the pivot axis in the circumferential direction, wherein the stop-mounting point is not a pre-tensioning mounting point.

5. The assembly process according to claim 4, wherein the stop element is a bearing arrangement provided on the first or on the second mounting point, said bearing arrangement contributing to the pivotable mounting of the at least one air flap.

* * * * *